United States Patent [19]

Fogal, Sr. et al.

[11] Patent Number: 4,958,587

[45] Date of Patent: Sep. 25, 1990

[54] APPARATUS FOR EXTERIORLY PAINTING AND INTERIORLY COATING TIRES

[75] Inventors: Robert D. Fogal, Sr.; Robert D. Fogal, Jr.; George E. D. Morgan, all of Chambersburg, Pa.

[73] Assignee: International Marketing, Inc., Chambersburg, Pa.

[21] Appl. No.: 373,361

[22] Filed: Jun. 29, 1989

[51] Int. Cl.[5] ..... B05C 1/02; B05B 13/06

[52] U.S. Cl. ..... 118/206; 118/214; 118/218; 118/219; 118/226; 118/241; 118/242; 118/266; 118/304; 118/315; 118/318; 118/321; 118/DIG. 7

[58] Field of Search ..... 118/206, 209, 211, 214, 118/216–219, 225, 226, 232, 241, 242, 256, 264, 266, 304, 315, 317, 318, 320, 321, DIG. 7

[56] References Cited

U.S. PATENT DOCUMENTS 4,206,008 6/1980 Tacke et al. ..... 118/318
4,306,826 12/1981 Detwiler ..... 118/320
4,430,958 2/1984 Boggs ..... 118/318
4,669,417 6/1987 Pederson et al. ..... 118/318
4,881,488 11/1989 Fantacci ..... 118/322

FOREIGN PATENT DOCUMENTS 51-3754 2/1976 Japan ..... 118/318
1219406 3/1986 U.S.S.R. ..... 118/320

*Primary Examiner*—James C. Housel
*Attorney, Agent, or Firm*—Diller, Ramik & Wight

[57] ABSTRACT

A machine for applying tire paint and tire sealant to recapped tire sidewalls and interiors, respectively. The machine includes a pair of tire paint applicator pads which are carried by a frame and carriage capable of reciprocal motion in three different directions to bring the applicator pads into selective engagement with tire sidewalls. The machine also includes spray nozzles carried by an associated frame and carriage for bringing the nozzles into a position to direct tire sealant into the interior of an associated recapped tire.

29 Claims, 10 Drawing Sheets

220
24
60
241
235
231
235
242
232
210
212
206
214
211
11
11
307
221
222
201
181
202
175
183
195
194
193
185
184
192
12
12
190
187
191
184
186
F
192

APPARATUS FOR EXTERIORLY PAINTING AND INTERIORLY COATING TIRES

BACKGROUND OF THE INVENTION

The invention is directed to the application of tire paint to the exterior sidewall surfaces of a recapped tire and simultaneously applying a coating to the interior surface of the tire casing. After a tire has been recapped it is normal to paint the exterior of the sidewalls with tire paint to give the recapped tire a "new" tire appearance. Furthermore, an impermeable coating is also preferably applied to the interior surface of the recapped tire which prevents pressurized air, when the recapped tire is mounted on a wheel or rim and pressurized, from migrating through pin holes or like imperfections in the tire and forming pressurized air pockets between the old tire and the new tread. These pressurized pockets result in tire imbalance at a minimum and at a maximum cause the tread to tear away from the old tire, a particularly dangerous situation when it occurs at high speeds upon congested highways.

Heretofore it was common practice to manually paint the sidewall exteriors and apply appropriate air impervious coating material to the tire interiors. This was time consuming and costly.

SUMMARY OF THE INVENTION

In keeping with the foregoing, a primary object of the present invention is to provide a novel apparatus or a machine for simultaneously applying tire paint to sidewall exteriors and impervious coating material to tire interiors.

In keeping with the present invention, the machine includes a pair of carriages, one carrying tire paint applicators and the other carrying applicators for applying air impervious coating material to the tire interior The applicators for the tire paint are preferably porous pads which are reciprocally moved toward and away from each other to bring the pads into and out of contact with the tire sidewalls when the tire is rotated preferably about its axis when disposed in a generally horizontal plane. The applicators for the coating material are preferably spray nozzles which spray the tire interiors during tire rotation.

The tire painting and coating applying machine of the invention preferably utilizes fluid motors, such as piston and cylinder mechanisms, for reciprocally slidably moving the carriage and portions thereof to bring the tire paint applicator pads and the coating material spray nozzles into and out of operative relationship to the tire during the overall operation of the machine.

In the foregoing manner, the machine of the present invention simultaneously applies tire paint to the tire sidewalls and coats the interior thereof in a relatively short period of time with minimum effort and at relatively low cost.

With the above, and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 2 is a block diagram, and illustrates the manner in which FIGS. 3 and 4 are united to collectively form a fragmentary front elevational view of the machine of FIG. 1.

FIGS. 3 and 4 collectively define a fragmentary front elevational view of the machine of FIG. 1, and illustrate a vertically reciprocal carriage carrying a horizontally reciprocal frame which in turn carries spray nozzles for directing coating into the interior of a tire during the rotation thereof, and one of a pair of applicator pads for exteriorly painting the tire sidewall.

FIG. 5 is a block diagram, and illustrates the manner in which FIGS. 6 and 7 are united to collectively form a top plan view of the carriage, frame and spray nozzles of FIGS. 3 and 4.

FIGS. 6 and 7 collectively define a top plan view of the carriage, frame and spray nozzles of FIGS. 3 and 4, and illustrate details thereof.

FIG. 10, is a fragmentary rear perspective view of one of the applicator pads, and illustrates details thereof.

DESCRIPTION OF THE PREFERRED EMBODIMENT

Figure 1:
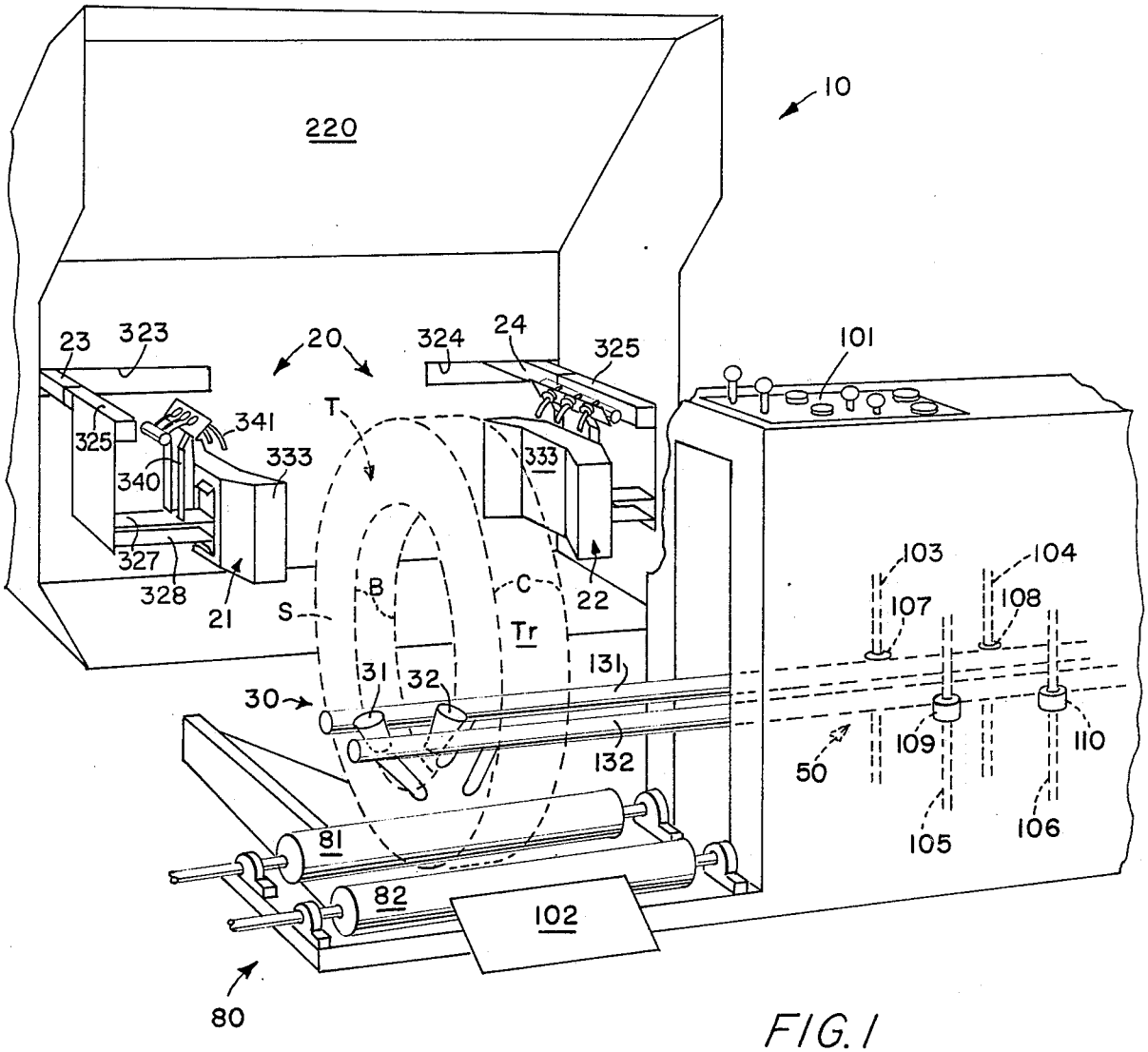
FIG. 1 is a fragmentary front perspective view of a novel machine or apparatus for exteriorly painting and interiorly coating recapped tires, and illustrates porous applicator pads and spray nozzles for respectively exteriorly painting and interiorly coating an associated recapped tire during the rotation thereof.

A novel apparatus or machine for painting the exterior sidewall surfaces of a recapped tire and coating the interior surfaces thereof is generally designated by the reference numeral 10 (FIG. 1).

The tire painting and coating machine 10 includes means 20 for painting the exterior sidewall surfaces of an associated tire and means 30 for spray coating the interior surface of a tire.

Figures 2, 3, 4:
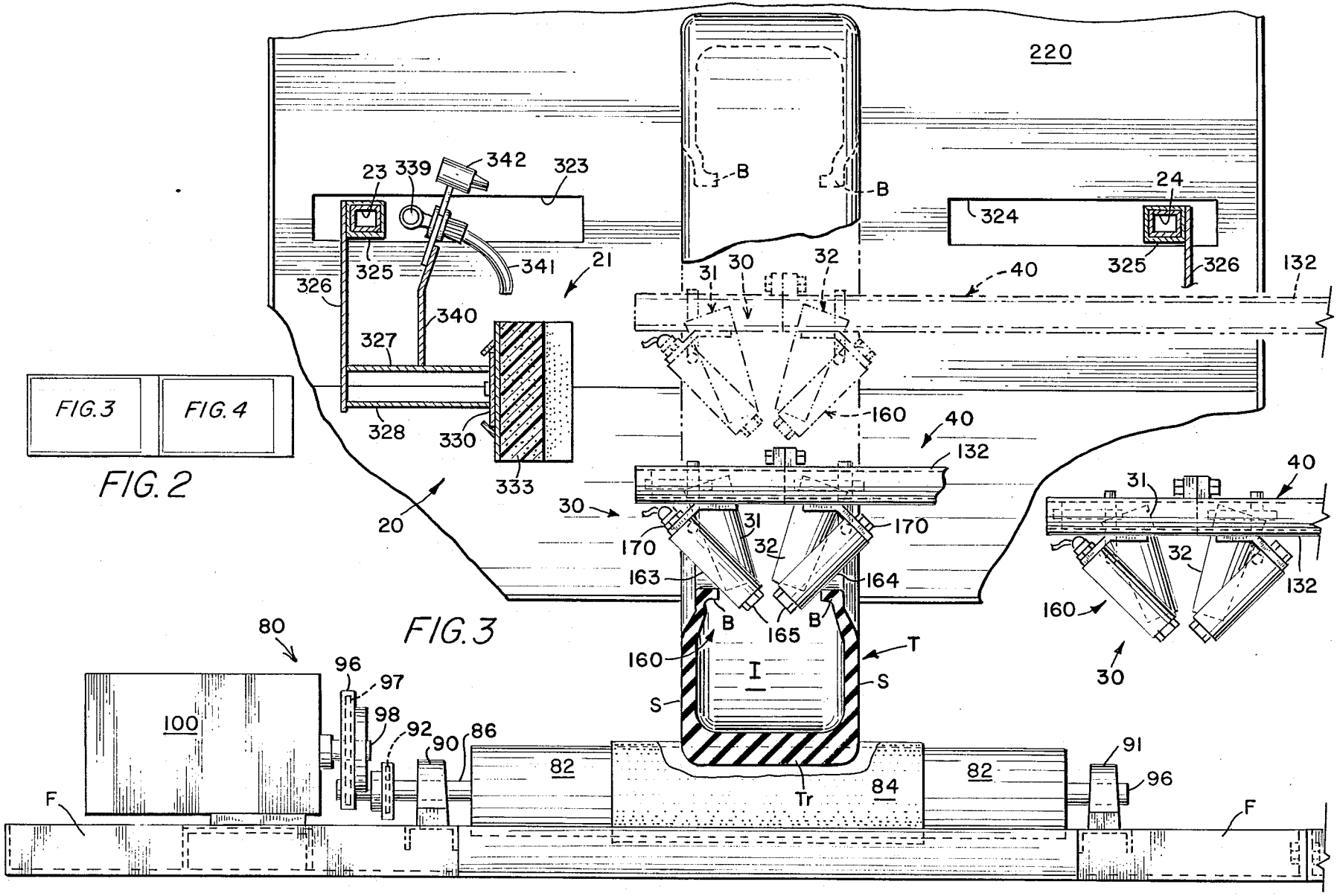
Figure 4:
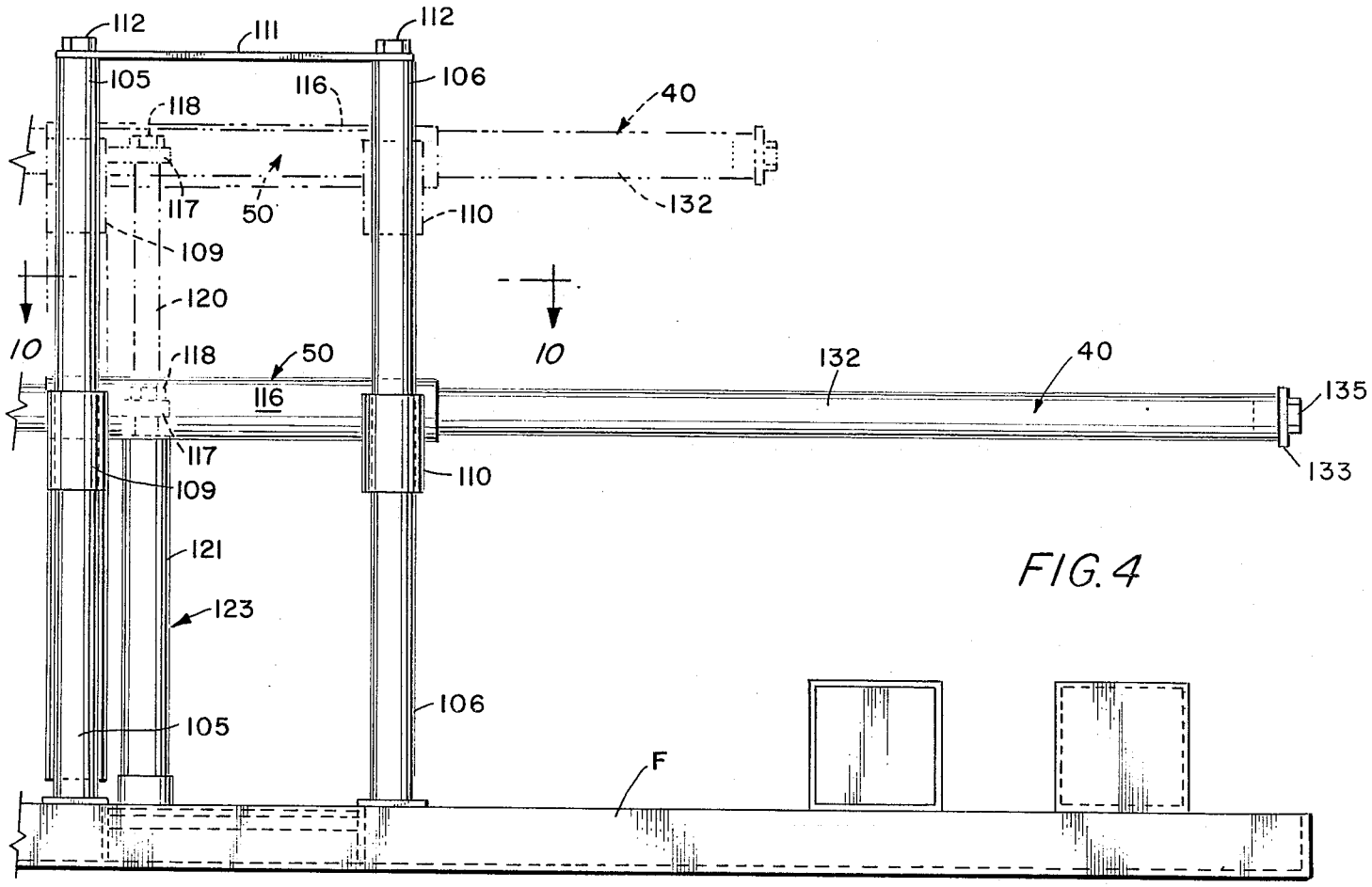

The spray coating means 30 (FIGS. 3, 4, 5 and 7) is carried by a frame 40 which is mounted for horizontal reciprocal motion, as is best viewed in FIGS. 2 and 4. The frame 40 is also in turn carried by a carriage 50 (FIGS. 4, 7 and 10) which is in turn mounted for reciprocal vertical sliding movement, as is best illustrated between the solid and phantom outline positions of FIG. 4.

The painting means 20 (FIGS. 8 and 9) includes identical paint applicator pads 21, 22 carried by respective applicator pad carrying arms 23, 24 which in turn partially define a frame 60 which is mounted for reciprocal sliding movement toward and away from each other. The frame 60 is in turn carried by a carriage 70 (FIGS. 8, 9, 11 and 12) which is mounted for vertical reciprocal movement, as is best visualized in FIGS. 8 and 12 of the drawings.

A recapped tire T (FIGS. 1 and 3) includes a tread or tread surface Tr, a sidewall or exterior sidewall surface S, a crown C between the tread Tr and each sidewall S, beads B and an interior surface I.

The tire T is rotated about its axis and the axis thereof is disposed in a generally horizontal plane during such rotation. As the tire T is rotated in a manner to be described more fully hereinafter, the paint applicator pads 21, 22 of the tire painting means 20 move toward each other from the position shown in FIG. 1 to contact the opposite sidewalls S and apply tire paint thereto. Prior to the operation of the tire painting means 20, simultaneously therewith, or thereafter, the spray coating means 30, which includes two spray heads 31, 32 (FIGS. 3 and 6), is operated to spray tire sealant or coating material upon the interior surface I.

Means for rotating the tire T is generally designated by the reference numeral 80 and includes a pair of rollers 81, 82 carrying respective rubber sleeves 83, 84 and being conventionally journalled for rotation relative to a machine frame F by respective shafts 85, 86 which are journalled for rotation in respective journals 87, 88 and 90, 91 (FIG. 5), respectively. The shaft 85 has a pair of gears 92, 93 keyed thereto and a gear 94 which is in alignment with the gear 92 is keyed to the shaft 86. A drive belt 95 is entrained about the gears 92, 94 and a similar drive belt 96 is entrained about the gear 93 and another gear 97 fixed to a shaft 98 of a drive motor 100 suitably supported upon the frame F. A suitable switch upon a control panel 101 (FIG. 1) can be energized and de-energized by an operator to energize and de-energize the motor 100 to impart rotation to the tire T. The rubber sleeves 83, 84 have a relatively high coefficient of friction and the tire T is accordingly driven or rotated positively in the absence of slippage to assure proper application of the paint and coating material, as will be more apparent hereinafter.

An inclined ramp 102 (FIG. 1) may be provided by welding to the frame F to enable the tire T to be rolled into the machine 10 upon the rollers 81, 82 and rolled out of the machine at the completion of the painting and coating operation. The tires T are relatively large truck tires and thus the ram 102 aids significantly in the manual loading and unloading thereof relative to the machine 10.

Figures 5, 6, 7:
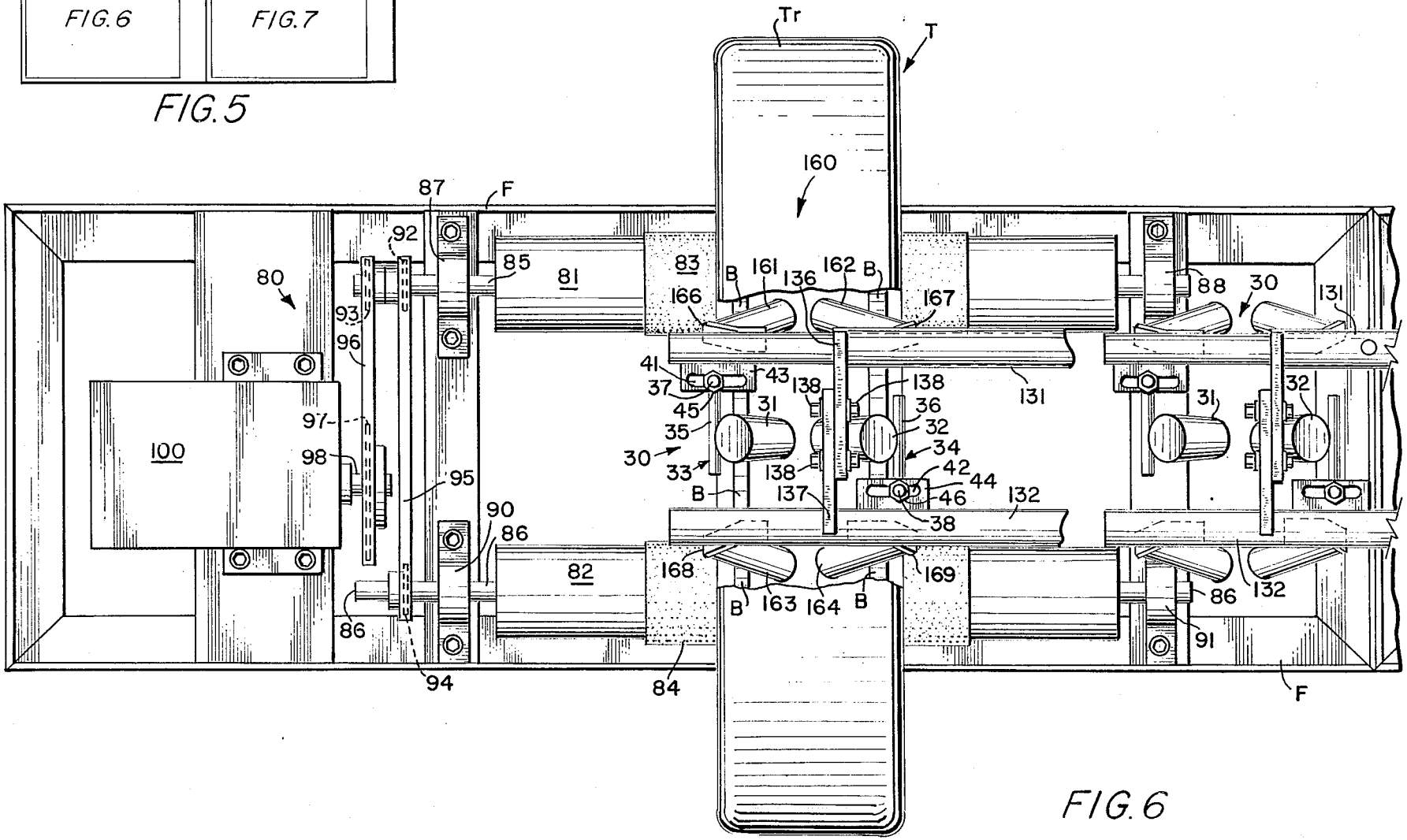
Figure 7:
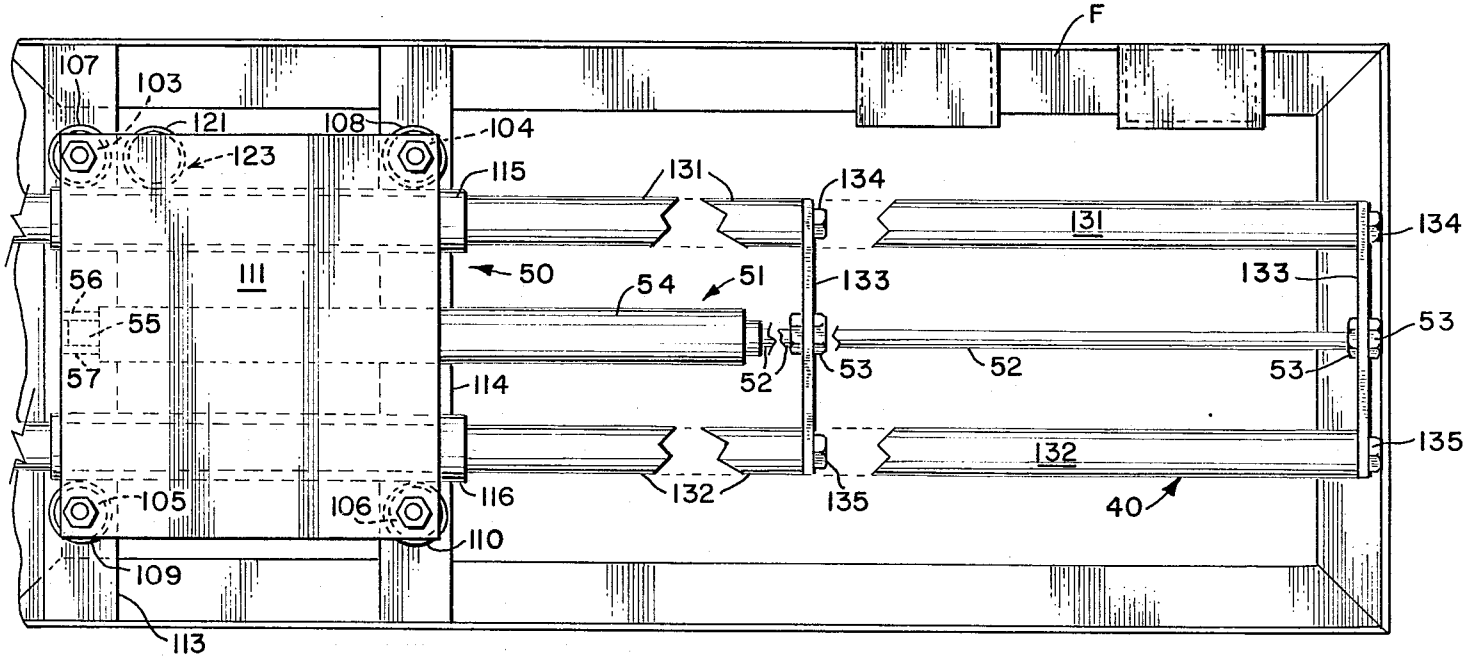
Figure 10:
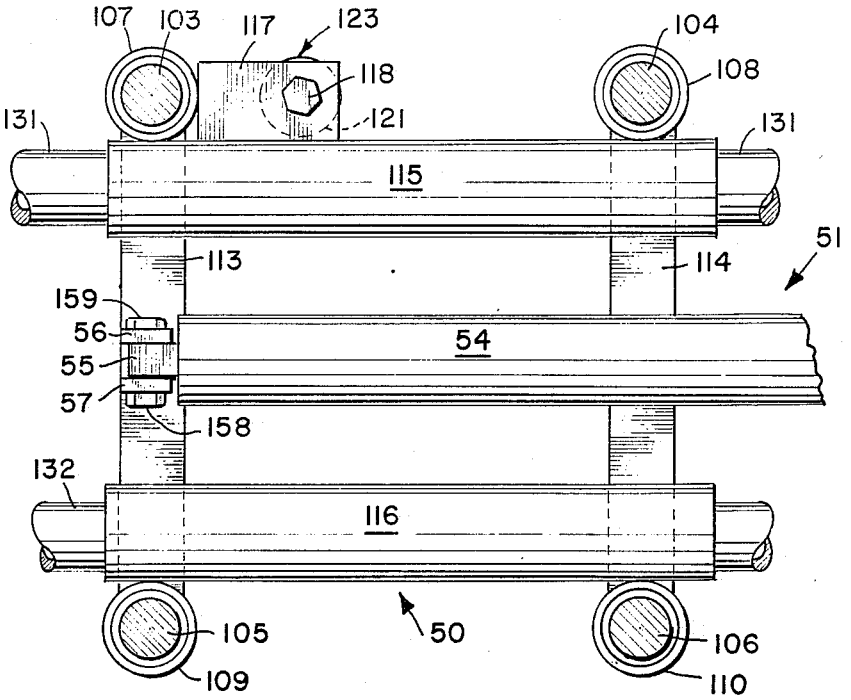
FIG. 10 is an enlarged cross sectional view taken generally along line 10—10 of FIG. 4, and illustrates the manner in which the carriage supporting the nozzles for spraying the interior of the tire is mounted for reciprocal movement.

Reference is now made particularly to FIGS. 3, 4, 6, 7 and 10 of the drawings, and particularly FIGS. 4, 7 and 10 which illustrate four generally upstanding cylindrical posts or rods, 103–106 which are welded at their lower ends to the frame F (FIG. 4). Four sleeves 107–110 are in external sliding relationship to the respective posts 103–106 and these sleeves 107–110 in part define the carriage 50. The upper ends of the posts 103–106 are rigidly secured together by means of a rectangular upper plate 111 having a hole (not shown) at each corner through which passes an identical bolt 112. Each of the bolts 112 is threaded into a threaded bore (not shown) in the upper ends of the posts 103–106. A pair of parallel members or bars 113, 114 have opposite convexly curved edges (unnumbered) which mate with and are welded to the exterior surfaces of the respective sleeves 107, 109 and 104, 110 (FIG. 10). A pair of tubular guide members or sleeves 115, 116 are positioned with their axes generally parallel to each other (FIG. 10) and these are in turn seated upon and welded to the members 113, 114. The guide tubes 115, 116 are also welded to the respective sleeves 107, 108 and 109, 110. Accordingly, the overall carriage 50 is defined by the sleeves 107–110, the members 113, 114 and the tubular guide members 115, 116, all welded together to define the relatively rigid carriage 50.

A plate 117 (FIGS. 4 and 10) is welded to the tubular guides sleeve 115 and is generally disposed in a horizontal plane, as is most evident from FIG. 4. A headed bolt 11B (FIGS. 4 and 10) passes through an opening (not shown) in the plate 117 and is threaded in a threaded bore (not shown) of a rod 120 carrying a piston (not shown) which is reciprocated in and relative to a cylinder 121 having a lower end 122 rigidly connected to the frame F. As hydraulic fluid, such as air, is introduced into and withdrawn from the rod and head ends of the cylinder 121, the rod 120 is selectively moved upwardly and downwardly, as is indicated in phantom outline in FIG. 4 to similarly move the carriage between the uppermost (phantom outline) and lowermost (solid line) positions shown in FIG. 4. The rod 120, cylinder 121 and associated piston define a fluid motor 123 which forms part of a fluid control circuit or system 200 (FIG. 15) which will be described more fully hereinafter.

The frame 40 is carried by the carriage 50 and includes a pair of cylindrical members or rods 131. 132 which are slidably received in and guided by the respective tubular guide members 115, 110 (FIGS. 7 and 10). The cylindrical rods 131,132 tied together in a rigid manner by a traversing plate 133 (FIGS. 4 and 7) which has openings (unnumbered) in opposite ends through which pass bolts 134, 135. The left-hand ends (unnumbered) of the rods 131, 132 have welded thereto respective plates 136, 137 (FIGS. 3 and 6) which partially overlap each other. The portions of the plates 136, 137 which overlap each other have elongated slots therein (not shown) through which pass headed bolts and which are secured by conventional nuts, the latter being collectively being designated by the reference numeral 138. Thus, the ends of the rods 131, 132 can be adjusted somewhat toward and away from each other limited, of course, by the clearance afforded the sliding relationship of the rods 131, 132 relative to the guide sleeves 115, 116 In other words, the left-hand ends of the rods 131, 132 can be adjusted toward and away from each other as desired so long as the rods 131, 132 do not bind relative to the tubular guide members 115, 116, and in any such position of adjustment the bolts and nuts 138 need but be tightened.

The nozzles 31, 32 of the coating means 30 are conventional nozzles and are fixed to a pair of generally L-shaped rods 33, 34, respectively, having respective horizontal legs 35, 36 and vertical threaded legs 37, 38 which pass through respective slots 41, 42 in respective brackets 43, 44 welded to the respective rods 131, 132. Pairs of nuts 45, 46 are threaded to each of the Legs 37, 38, respectively, one each above and below the plates 43, 44. The nuts 45, 46 can be loosened and tightened to selectively adjust the nozzles 31, 32 such that the coating sprayed therefrom will be applied toward opposite sides of the tire interior I with a slight overlap along the center. For example, in FIG. 1 the coating sprayed from the nozzle 31 is directed to the right-hand side of the tire interior I, while the spray from the nozzle 32 is directed to the left-hand side of the tire interior I with an overlap along the center. Furthermore, the sprays issuing from the nozzles 31, 32 are disposed generally in a Vertical plane and the vertical plane of each spray is slightly offset from and parallel to the vertical plane of the other spray so that the two sprays do not interfere with each other and the entire tire interior I of the tire T is appropriately thoroughly evenly coated.

The frame 40 is also reciprocated in a horizontal plane by a fluid motor 51 (FIGS. 7 and 10) which includes a piston rod 52 having a threaded end (unnumbered)passed through an opening (unnumbered) of the plate 133 and secured thereto in a conventional manner by identical nuts 53. The rod 52 carries a piston (not shown) which is housed in a cylinder 54 for relative reciprocal sliding motion therein. The cylinder 54 includes a tubular journal 55 (FIG. 10) which is sandwiched between a pair of upstanding lugs 56, 57 welded to the cross member 113. A bolt 158 passes through openings (unnumbered) of the lugs 56, 57 and the tubular journal 55 and is secured thereto by a nut 59. As hydraulic fluid, such as air, is introduced into and withdrawn from the cylinder 54 of the fluid motor 51 the piston rod 52 is appropriately reciprocated to move the frame 40 horizontally between the two solid line positions shown in FIG. 3. Obviously, the carriage 50 can be moved up and down, as was earlier described, and the frame 40 can therefore be moved to an uppermost position, as shown in phantom outline in FIG. 3. By selectively operating a switch on the console 10 (FIG. 1), the frame 40 can be moved, for example, from its retracted lower position (right-handmost position of FIG. 3) upwardly by upward movement imparted to the carriage 50 followed by leftward movement to the phantom outline position shown in FIG. 3 and then downwardly to the left-hand solid line position shown in FIG. 3 at which the nozzles 31, 32 are actuated to spray the interior I of the tire T. Thereafter, the switches on the console 101 are operated in the reverse sequence to move the carriage 50 upwardly bringing the nozzles 31, 32 to the phantom outline position shown in FIG. 3, thereafter the fluid motor 51 is actuated to shift the nozzles 31, 32 to the right by like rightward shifting of the rods 131, 132, and subsequent downward movement to the "home" position, which is the right-hand solid position of the spray coating means 30 in FIG. 3.

In further accordance with the present invention the beads B of the tire T are also spread outwardly and the tire T is supported during its rotation by the rollers 81, 82 by tire supporting and bead spreading means 160 which includes a pair of downwardly converging cylindrical rollers 161, 162 carried by the carrying arm or cylindrical rod 131 of the frame 40 and a like pair of downwardly converging cylindrical rollers 163, 164 carried by the cylindrical member or carrying arm 132. The rollers 161–164 each receive a headed bolt 165 (FIG. 3) therethrough with a threaded end of each bolt passing through an opening (unnumbered) of respective angle brackets 166–169. A nut 170 is threaded through the threaded end of each bolt 165 to retain the bolts 165 upon the respective brackets 166–169 while permitting rotation of the rollers 161–164 relative to the bolts 165. It will be noted from FIG. 3 that the left-hand solid illustration of the spray coating means 30 is slightly above the right-hand solid illustration of the spray coating means 30. Thus in the position of the left-hand solid line illustration of the spray coating means 30, the rollers 161–164 are in contact with the beads B at four different points, as is most apparent in FIGS. 3 and 6. If the distance between the beads B is sufficient to permit the nozzles 31, 32 to direct the spray therein, the spraying operation can take place, but if it is desired to spread the beads B further, the fluid cylinder 123 is actuated to draw the rod 120 further downwardly which draws the carriage 50 downwardly and along therewith draws the carrying arms 131, 132 downwardly. This downward motion brings the converging rollers 161–164 downwardly further into the tire interior I and thus progressively spreads the beads B to assure a sufficient space therebetween for coating the tire interior I from the spray nozzles 31, 32.

Figure 8:
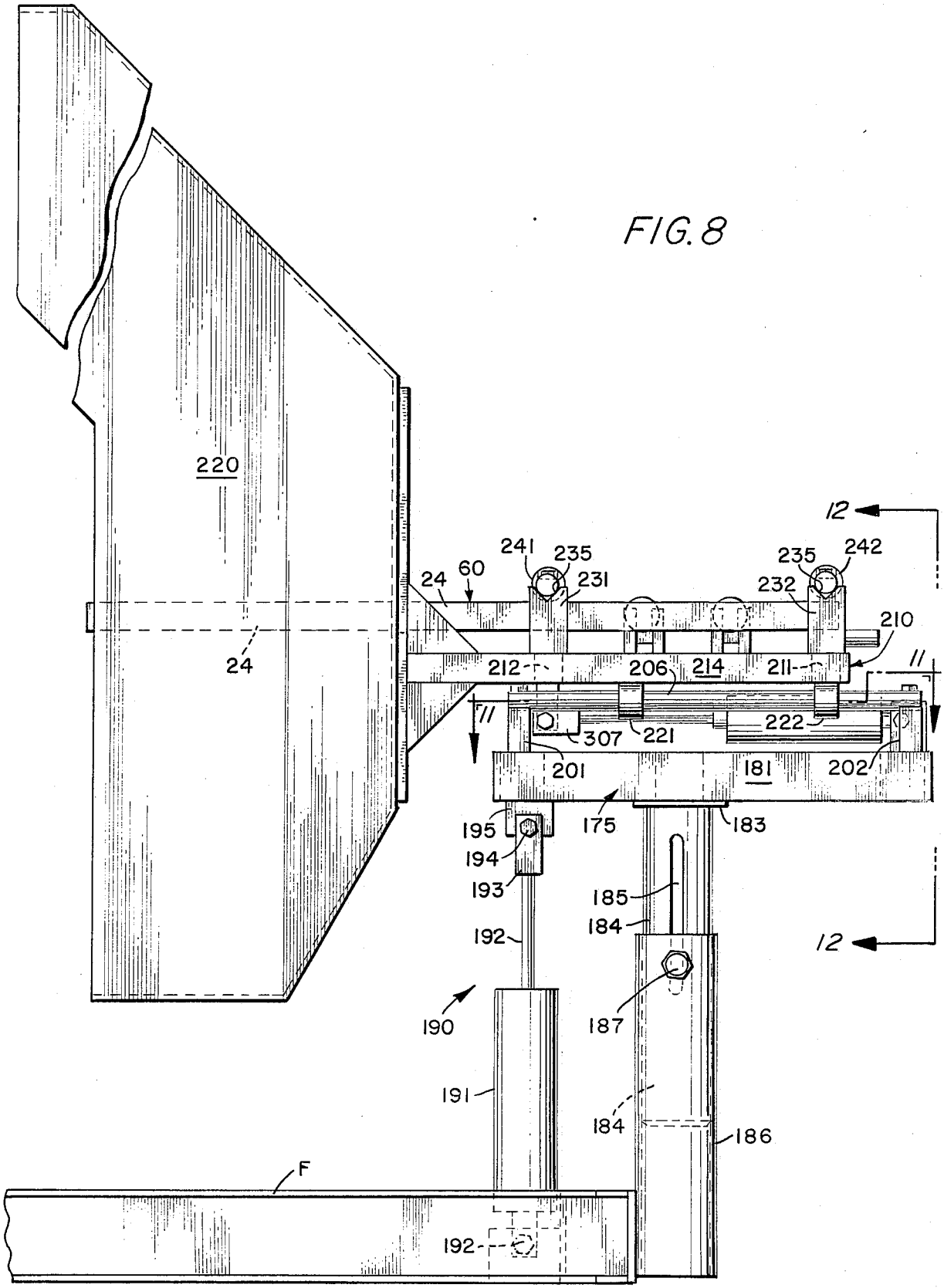
FIG. 8 is a side elevational view taken generally along line 8—8 of FIG. 1 and illustrates another vertically reciprocal carriage carrying a frame for moving tire paint applicators into and out of contact with sidewalls of the tire.

Reference is now made particularly to FIGS. 8, 9 11 and 12 of the drawings and the construction of the carriage 70 which supports the frame 60 for moving the applicator pad carrying arms 23, 24 vertically upward and downward so that the applicator pads 21, 22 can be positioned to accommodate and embrace therebetween sidewalls S (FIG. 1) of differently sized tires T. The carriage 70 includes a generally polygonal framework 175 formed by three generally parallel framework members 176, 177, and 178 and two other generally parallel framework members 181, 182 (FIG. 11) which are welded to each other. A rectangular plate 183 is welded to the underside of the member 177 and welded to the plate 183 is a cylindrical tube 184 having opposite diametrical vertical slots 185 (FIG. 8). The cylindrical tube or sleeve 184 is slidably received in another cylindrical tube or sleeve 186 having diametrically opposite openings (unnumbered) through which passes a bolt 187. An opposite end (not shown) of the bolt 187 has secured thereto a nut 188. A lower end (unnumbered) of the sleeve 186 is welded to the frame F, as is clearly evident from FIG. 8. The bolt 187 cooperates with the diametrical vertical slots 185 to assure that the sleeve 184 will not rotate during its vertical reciprocal motion under the influence of a fluid motor 190 which includes a cylinder 191 having a lower end conventionally pivoted at 192 to the frame F. The cylinder 191 houses a piston (not shown) connected to a piston rod 192, which in turn carries a yoke 193 connected by a bolt 194 to a downwardly depending plate 195 welded to the underside of the framework member 176. As will be described more fully hereinafter, as the rod 192 is moved up or down by air introduced into the cylinder 191, the polygonal framework 175 will be similarly moved along with the frame 60 carried thereby.

Figure 12:
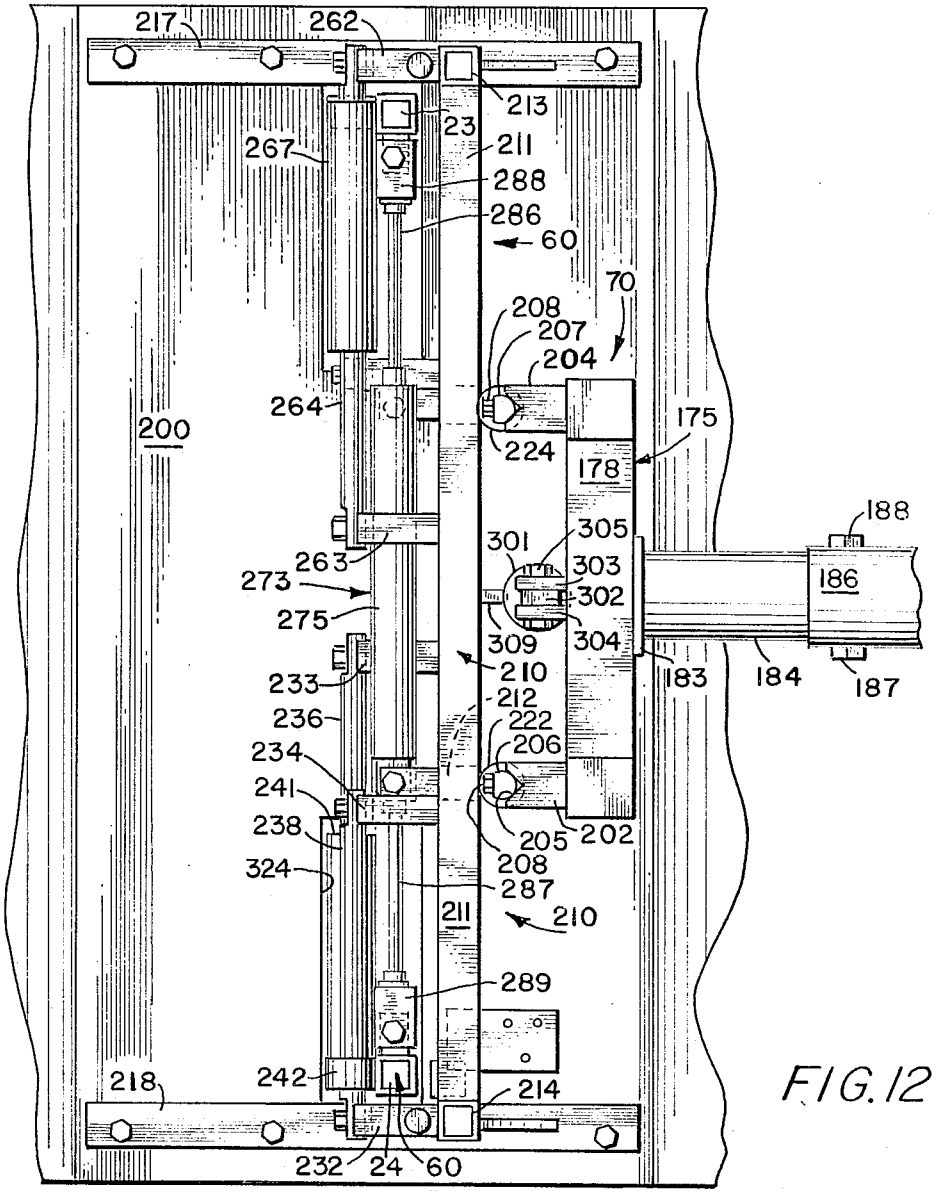
FIG. 12 is an enlarged end elevational view taken generally along line 12—12 of FIG. 8, and illustrates two fluid motors for moving frame members carrying the applicator pads toward and away from each other along paths generally parallel to the tire axis.
Figure 11:
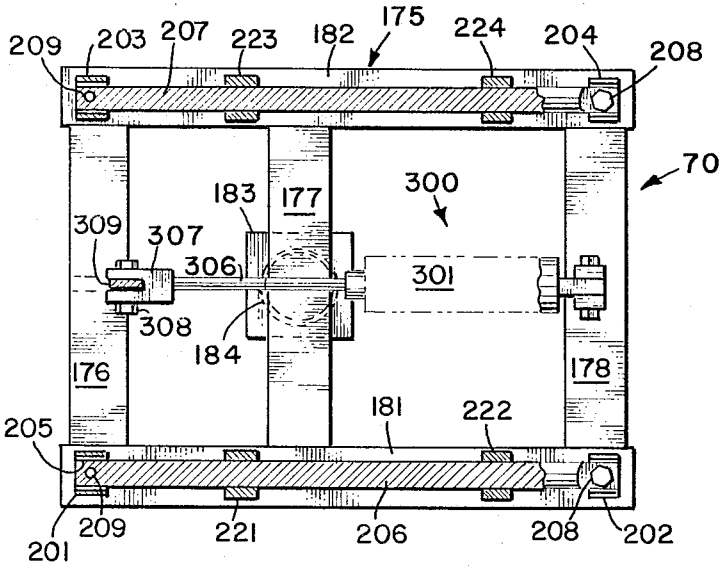
FIG. 11 is a cross sectional view taken generally along line 11—11 of FIG. 8, and illustrates fluid motor for reciprocating the frame of the tire paint applicators generally normal to the tire axis during the rotation thereof.

The polygonal framework 175 of the carriage 70 carries a relatively short post 201–204 at each of the corners (unnumbered) of the framework member 175, as is best illustrated in FIG. 11. The posts 201, 202 are welded to the framework member 181 and the posts 203, 204 are welded to the framework member 182. The posts 201–204 each has an upwardly opening generally V-shaped notch 205 (FIG. 12). A cylindrical guide rod 206 has its opposite ends seated in the V-shaped notches 205 of the posts 201, 202 while a similar cylindrical guide rod 207 has its opposite ends seated in the V-shaped notches 205 of the posts 203, 204. A bolt 208 passes through an opening 209 (FIG. 11) in each of the ends (unnumbered) of the rods 206 and is threaded in threaded bores (not shown) of the respective posts 201–204. Thus the cylindrical guide rods 206, 207 are rigidly secured in parallel relationship to each other and to the framework members 181, 182 immediately therebelow.

Figure 9:
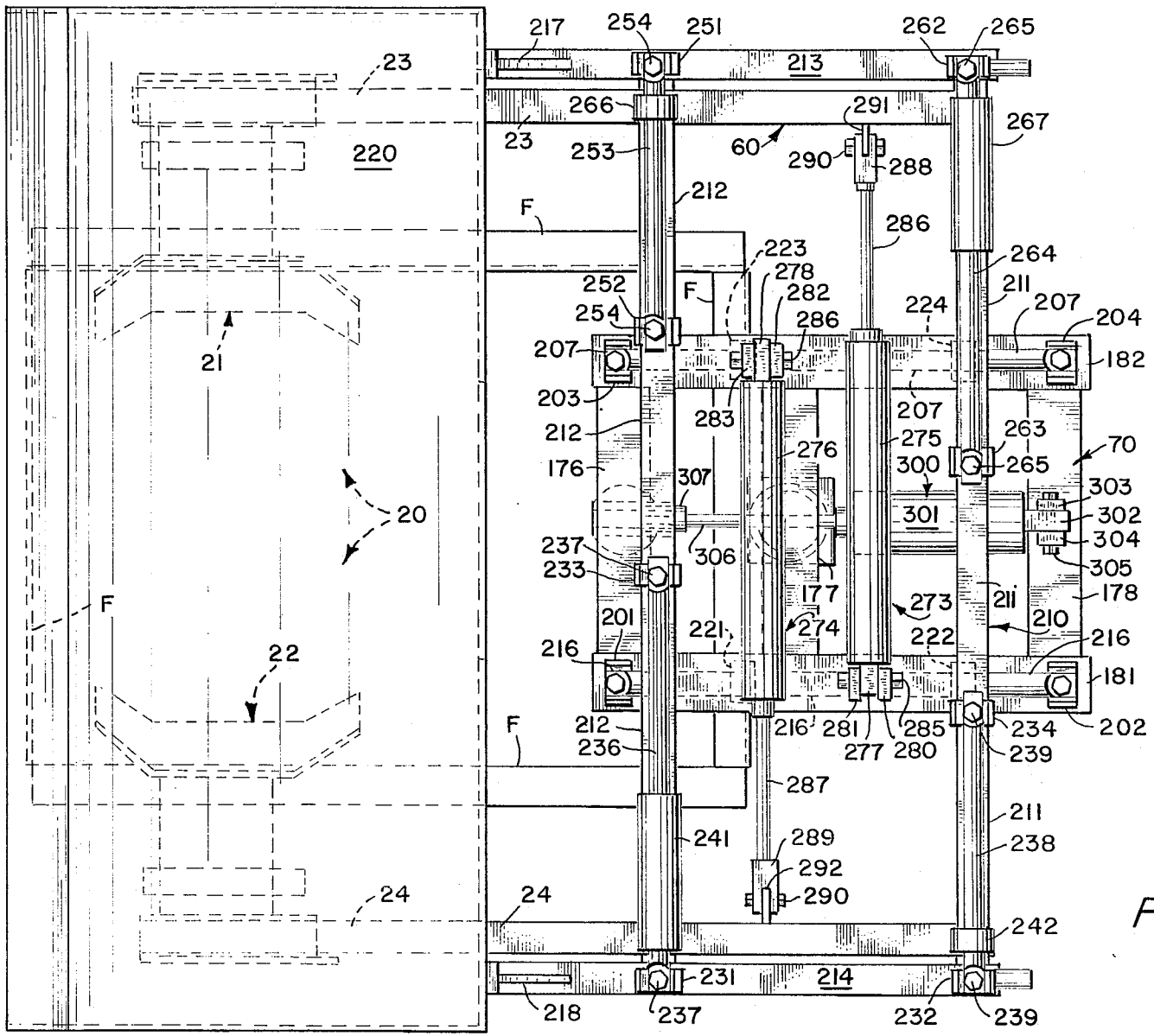
FIG. 9 is a top plan view looking downwardly in FIG. 8, and illustrates the carriage, the frame and fluid motors associated with the carriage and frame for moving the applicator pads into and out of contact with sidewalls of the tire.

Another framework 210 is positioned above the framework 175 (FIG. 12) and is mounted for reciprocal sliding motion relative thereto, left-to-right, as viewed in FIGS. 8 and 9 of the drawings The framework 210 includes two relatively long members 21, 212 which are in parallel relationship to each other and are of a rectangular cross sectional configuration. Opposite ends of the members 211, 212 are welded to similarly cross sectioned members 213, 214 (FIG. 9) which are in parallel relationship to each other. Two other rectangular cross section members 215, 216 are in spaced parallel relationship to each other and opposite ends thereof are welded to the members 211, 212. Thus the members 211, 212, 215, 216 define a generally H-shaped frame, as viewed from above in FIG. 9, and the ends thereof are closed and spanned by the members 213, 214 whose left-hand ends 217, 218, respectively, are welded to a hood 220. A pair of sleeves 221, 222 (FIGS. 8 and 9) are welded to the underside of the member 210 and are slidable upon the rod 206. Like sleeves 223, 224 are welded to the underside of the member 215 and are slidable upon the rod 207. Accordingly, the entire framework 20 can slide or reciprocate from left to right in FIGS. 8 and 9, and vice versa, along with the hood 220 carried by the arms 213, 214, and the applicator pad carrying arms 23, 24, as will be described more fully hereinafter.

The member 214 carries a pair of upstanding posts 231, 232 (FIGS. 8 and 9) and in alignment therewith are posts 233, 234 carried by the respective members 212, 211 (FIG. 9). Each of the posts 231–234 has an upwardly facing V-shaped notch 235 (FIG. 8). A rod 236 is seated in the V-shaped notches 235 of the posts 231, 233 and is secured thereto by bolts 237 passing through openings (unnumbered) in the ends of the rod 236 which are threaded in threaded bores (not shown) in the posts 231, 233. Another cylindrical rod 238 is seated in the V-shaped notches 235 of the posts 232, 234 and are secured therein by similar bolts 239. A relatively long sleeve 241 and a shorter sleeve 242 are slidably mounted for reciprocal motion on the respective rods 230, 238. The undersides of the sleeves 241, 242 are welded to the applicator pad carrying arm 24. Thus the sleeves 241, 242 can slide along the rods 236, 238, respectively, and carry therewith the applicator pad carrying arm 24 and the applicator pad 22 carried thereby, as will be described more fully hereinafter. Another upstanding post 251 is carried by the member 213 (FIG. 9) and is in alignment with an upstanding post 252 carried by the member 212. The posts 251, 252 have upwardly facing V-shaped notches, identical to the notches 235, and spanning these is a cylindrical rod 253 which is fixed at its ends 251, 252, by threaded bolts 254. The bolts 254 pass through openings in the ends of the rod 253 (not shown) and are threaded in threaded bores (also not shown) of the upstanding posts 251, 252. Another upstanding post 262 is carried by the member 231 and the V-shaped notch thereof (unnumbered) is aligned with a like V-shaped notch of a post 263 carried by the member 211. A cylindrical rod 264 has its ends (unnumbered) seated in the V-shaped notches of the posts 262, 263, and these ends are secured thereto by threaded bolts 265. The rod 253 is slidably received in a tubular guide or sleeve 266 while the rod 264 is similarly slidably received in a tubular sleeve 267. The sleeve 266 is welded to the applicator pad carrying arm 23, as is the sleeve 267. Accordingly, the applicator pad carrying arm 23 can be slid toward and away from the applicator pad carrying arm 24, as is best viewed in FIG. 9, and such sliding action is guided and controlled by the sleeves 266, 267 sliding along the rods 253, 264.

A pair of fluid motors 273, 274 are connected to the respective applicator pad carrying arms 23, 24 for reciprocating the same toward and away from each other. The fluid motors 273, 274 include respective cylinders 275, 276 having trunions 277, 278 sandwiched between upstanding lugs 280, 281 and 282, 283 which are in turn welded to the respective members 216, 215. Bolts and nuts 285, 286, respectively, pivotally connect the trunions 277, 278 to the respective lugs 280, 281 and 282, 283. A piston rod 286, 287 carrying a piston (not shown) is reciprocally mounted in the respective cylinders 275, 276 and bifurcated fittings 288, 289, respectively, are pivotally connected by pivot pins or bolts 290, to plates 291, 292 which are in turn welded to the respective applicator pad carrying arms 23, 24. When air is introduced into the rod ends of the cylinders 275, 276, the respective rods 286, 287 are drawn inwardly into the cylinders 275, 276 resulting in the applicator pad carrying arms 23, 24 being moved toward each other from the position shown in FIG. 3, while reverse motion is imparted thereto when air is introduced into the cylinder ends of the cylinders 275, 276. In this fashion the applicator pads 21, 22 can be moved into and out of engagement with the sidewalls S of the tire T, as is most apparent from FIGS. 1, 3 and 9 of the drawings, upon the appropriate introduction of air into and/or removal from the fluid motors 273, 274.

Depending upon the particular size and/or diameter of the tire T, the applicator pads 21, 22 are also moved forwardly and rearwardly, or front to back as viewed in FIG. 1 which is left-to-right in FIG. 9, by another fluid motor 300 which includes a cylinder 301 carrying a trunion 302 which is sandwiched between upstanding lugs 303, 304. A pivot pin 305 pivotally connects the trunion 302 between the lugs 303, 304. A rod 306 carries a piston which is mounted for reciprocal movement in the cylinder 301 and also carries a bifurcated connector 307 (FIG. 11) which is connected by a pivot pin 308 to a vertical plate 309 depending from and welded to the underside of the member 212. As air is introduced into the rod end of the cylinder 301, the rod 306 is retracted into the cylinder 301 or moved from left-to-right, as viewed in FIG. 9, which thereby moves the entire framework 210 to the right carrying with it the applicator pad carrying arms 23, 24 and the applicator pads 21, 22 thereof. Opposite motion imparted to the rod 306 moves the frame 210 to the left, as viewed in FIG. 9. From the foregoing, the fluid motor 190 is effective to raise and lower the entire carriage 70 and all components thereof including, of course, the framework 175 (FIG. 8). The operation of the fluid motor 300 moves the framework 210 left-to-right and vice versa, as viewed in FIGS. 8 and 9, while operation of the fluid motors 273, 274 moves the applicator pad carrying arms 23, 24 toward and away from each other. In this fashion, irrespective of the size and/or diameter of the tire T, the applicator pads 21, 22 can be accurately positioned as desired to embrace the sidewalls S of the tire T therebetween and apply tire paint to the sidewalls, as will be described immediately hereinafter.

The applicator pad carrying arms 23, 24 project forwardly through horizontally aligned elongated generally polygonal or rectangular slots 323, 324, respectively, formed in the hood 220, as is best illustrated in FIGS. 1 and 3 of the drawings. The applicator pad carrying arms 23, 24 are generally of a tubular rectangular cross sectional configuration, as shown in FIG. 3, and a like contoured tubular sleeve 325 is slidably inserted upon each and is welded thereto. A generally rectangular suspension bracket or plate 326 is welded to each tubular sleeve 325 and has a pair of horizontally disposed spaced parallel plates 327, 328 welded thereto. A mounting plate 330 is welded to the plates or supporting arms 327, 328.

Each applicator pad 21, 22 includes a back-up plate 332 of a generally shallow U-shaped configuration to which is adhesively bonded a porous liquid absorbing plastic paint applying pad or sponge 333. The plate 332 has struck therefrom and bent rearwardly a pair converging upper and lower plates 334, 335, respectively, and side lugs 337 are welded to the plate 332. The side lugs 336, 337 prevent side-to-side motion between the plate 330 and the plate 332. However, the plates 334, 335 are spaced sufficiently apart from each other to allow the upper edge (unnumbered) of the plate 330 to be inserted under and upwardly against the plate 334 and pivoted inwardly such that a lowered edge (unnumbered) of the plate 330 passes the free edge (unnumbered) of the plate 335. Thereafter, the plate 330 is dropped downwardly to the position shown in FIG. 4 at which point the lower edge of the plate 330 is supported by the plate 335, yet the upper edge of the plate 330 cannot pass to the left, as viewed in FIG. 14, beyond the plate 334. Obviously, in order to remove the applicator pad 221 or 22 from the plate 330, the latter described operation need but be reversed. In this manner should the plastic paint applying pads 333 wear and need replacement, the entire applicator pad 21, 22 can be removed and replaced as need be with little effort and virtually no down-time of the operation machine 10.

The upper plate 327 of each of the tire paint applicators 20 carries a vertical plate 340 to each of which is connected a paint manifold 341 connected to a suitable source of pressurized paint and three paint dispensing nozzles 341 having outlets in overlying relationship to the porous paint pads 333 (FIGS. 1 and 3 of the drawings). A spray nozzle 342 is also carried by each bracket 340 and is connected to the latter in a readily adjustable fashion. The spray nozzle 342 is also connected to the source of tire paint and the spray discharge therefrom is directed toward the crown C of the tire T, which in many tires is concave or has concave portions which may not be embraced when painted by the paint applying pads 333. Accordingly, as the arms 23, 24 are moved toward each other from the solid outline positions of FIGS. 1, 3 and 9, while the tire T is rotated, the pads 333 and the nozzles 342 will apply tire paint to the sidewalls S and the crown portions C of the tire T simultaneously with, prior to or after the spray of the coating material into the tire interior I by the spray nozzles 31, 32, in the manner heretofore described.

The fluid control circuit or system 200 (FIG. 15) for controlling the operation of the machine 10 will now be described and it is to be particularly understood that various ones of the switches, and levers and the like are preferably mounted upon the control panel or console 101 (FIG. 1) but these can likewise be formed as foot pedals. Furthermore, associated limit switches and check valves are utilized as necessary in a conventional manner.

The control system 200 includes a conventional source of pressurized air 351 which is connected by a line 352, a line 353, a line 354, a line 355 and a line 356 to a switching valve 357 operated by a handle 358 positioned upon the console 101 (FIG. 1). When the handle 358 is in the solid line position shown in FIG. 15 with the switch valve 357 shifted to the right, air from the line 357 is introduced into the rod end of the cylinder 54 over a line 361 and a flow control valve 362 while air is vented from the cylinder end of the cylinder 54 through a line 363 and a check valve 364 associated therewith. The carriage 50 is in its uppermost position (phantom outline in FIG. 4) and thus, as air is introduced into the rod end of the cylinder 54, the rod 52 is retracted into the cylinder 54 drawing the frame 40 from right-to-left, as viewed in FIGS. 4, 7 and 3, until the spray coating means or nozzles 31, 32 are in the phantom outline position shown in FIG. 2. At this time the tire T has not yet begun rotating.

Figure 15:
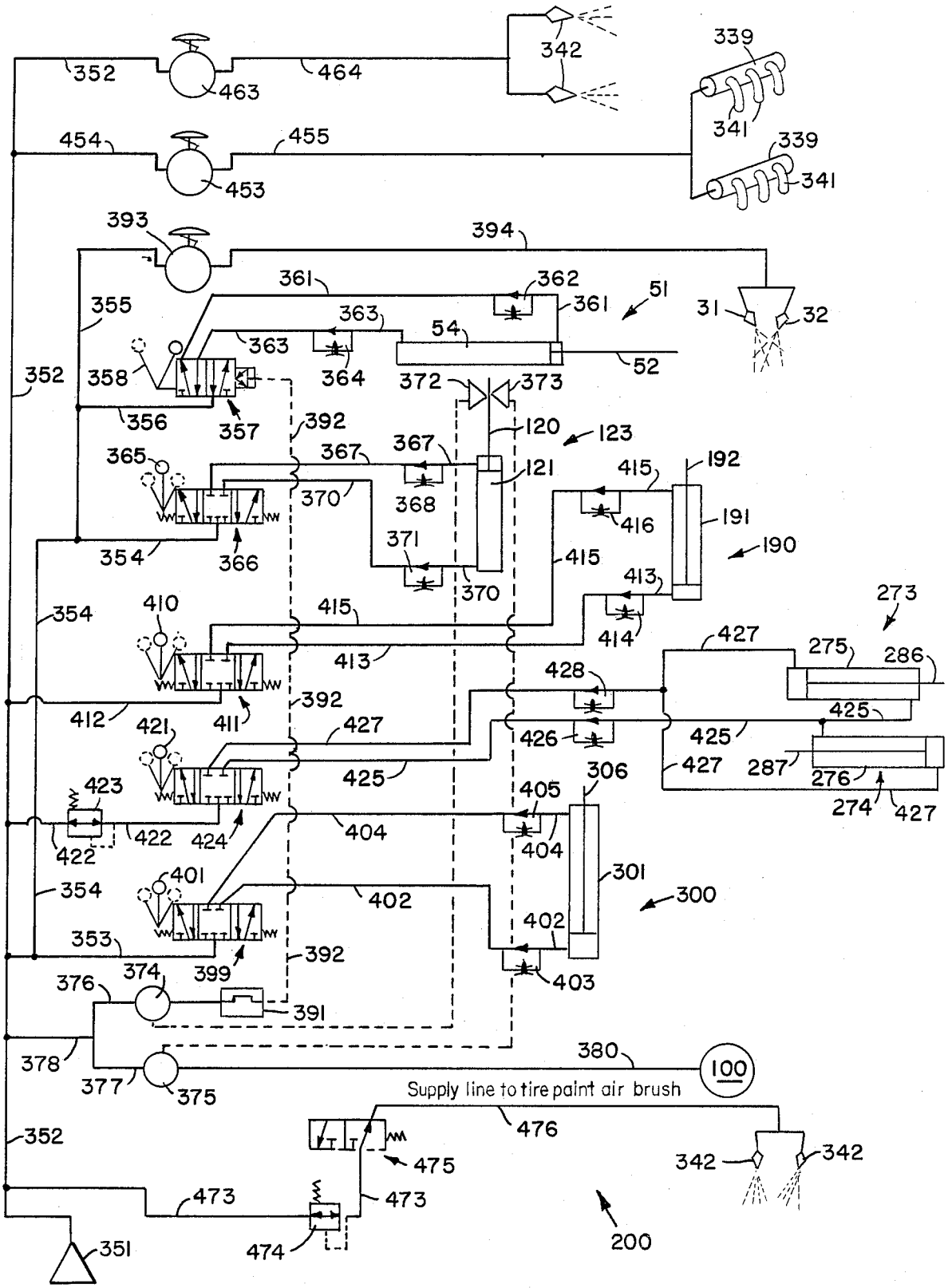
FIG. 15 is a pneumatic diagram and illustrates details of a pneumatic circuit for effecting the operation of various components of the machine for exteriorly painting and interiorly coating an associated recapped tire.

A handle 365 located on the console 101 of a switching valve 366 is then moved to the right, as viewed in FIG. 15, which directs pressurized air from the line 354 into a line 367 through a control valve 368 into the rod end of the cylinder 121 drawing the rod 120 therein as air is vented from the cylinder end of the cylinder 121 through a line 370 and a flow control valve 371 associated therewith. A pair of switches 372, 373 are operated during the retraction of the rod 120 to open valves 374, 375, respectively, in lines 376, 377 which are connected by a line 378 to the main line 352. Pressurized air from the line 352 flows through the line 378, the line 377, the open valve 375 and a line 380 to the air drive of the drive motor 100 which in turn rotates the rollers 81, 82 to rotate the tire T. Thus, as the tire T begins rotating, the rod 120 continues its downward descent to move the carriage 50 and the frame 40 from the phantom outline position shown in FIG. 3 to the solid line position immediately therebelow during which time the rollers 161 - 164 (FIG. 6) engage the tire beads B, spreading the same and maintaining the tire T stabilized during the rotation thereof.

The opening of the valve 374 also generates an air pulse through a reset pulse valve 391 and a line 392 to the switching valve 357 which shifts the latter to its neutral position holding the rod 52 retracted, and therefore maintaining the rollers 161164 and the nozzles 31, 32 in the position shown in the leftmost solid line position of FIG. 3.

A normally closed spring-biased open palm actuated valve 393 located on the console 101 is depressed which directs pressure seal coating material from a source (not shown) through a line 394 to the nozzles 31, 32 which spray the interior I of the tire T as the latter rotates. When the tire T has rotated at least one complete revolution, the palm actuated valve 393 is released and is spring-biased back to its closed position cutting off air pressure over the line 355 and terminating the spray of the pressure seal coating material from the nozzles 31, 32.

Assuming that the rod 306 is retracted in the cylinder 301 of the fluid motor 300, another handle 401 on the console 101 is shifted to the left, as viewed in FIG. 15, which causes pressurized air to travel from the line 352 through the line 353, and a switching valve 399 through a line 402 which includes a flow control valve 403 into the head end of the cylinder 301. Air is vented from the rod end of the cylinder 301 through a line 404 which includes a flow control valve 405. The rod 306 thus moves from right-to-left out of the cylinder 301, as viewed in FIGS. 8 and 9 of the drawings, to position the applicator pads 21, 22 in alignment with the sidewalls S of the tire T.

If the applicator pads 21, 22 are not aligned with the sidewalls S of the tire T elevationally or height-wise, a handle 410 of a switching valve 411 is appropriately manipulated to the left or right from the position illustrated in FIG. 15 to operate the rod 192 to either elevate or lower the frame 70 (FIG. 8). If the handle 410 is shifted to the left, the pressurized air in the line 352 is conducted through a line 412 through the valve 411 and a line 413 which includes a flow control valve 414 into the head end of the cylinder 191 while air is exhausted from the rod end of the cylinder 191 through a line 415 which includes a check valve 416. The rod 192 is thus extended from the cylinder 191 to elevate the carriage 70 while operation of the handle 410 in an opposite direction results in the reversal of the flow of air in the lines 413, 415 to retract the rod 192 and thus lower the carriage 70, as circumstances dictate.

Figure 13:
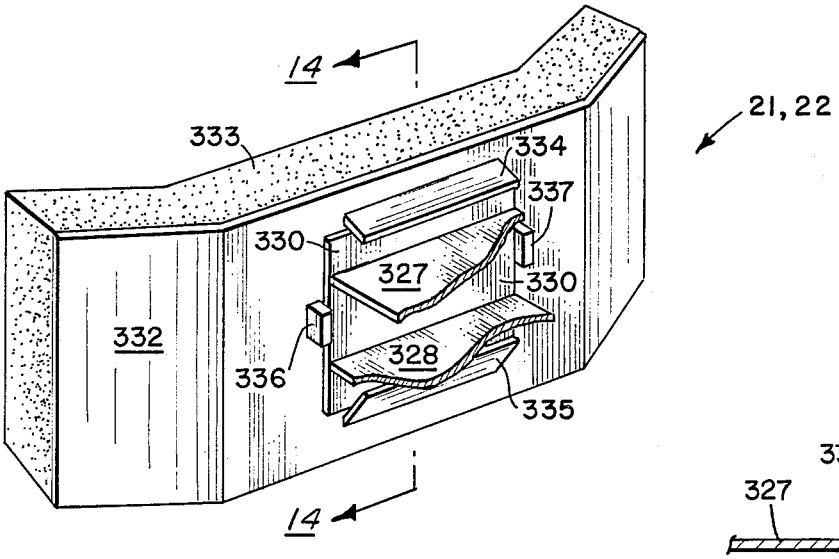
FIG. 13 which appears on the sheet of drawing containing
Figure 14:
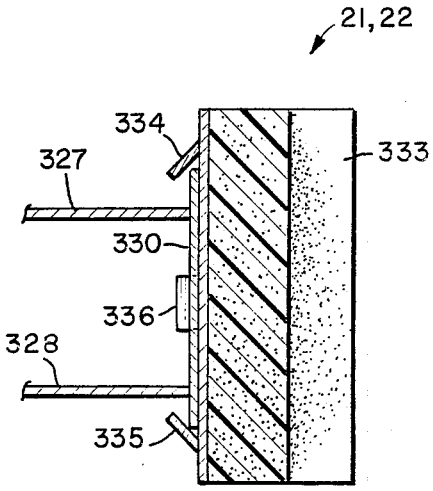
FIG. 14 is a cross sectional view taken generally along line 14—14 of FIG. 13 and illustrates the manner in which the applicator pad is removably secured to a supporting arm.

A handle 421 which is also conventionally located upon the console 101 is shifted to the left, as viewed in FIG. 15, which directs air from the line 352 over a line 422 and an associated pressure regulator 423 through a switching valve 424 into a line 425 having a flow control valve 426 into the rod ends of each of the cylinders 275, 276 while venting occurs from the cylinder ends of the cylinders 275, 276, over a line 427 having a flow control valve 428. The rods 286, 287 are drawn into the respective cylinders 275, 276 which in turn draw the applicator pad carrying arms 23, 24 (FIG. 9) toward each other and thus bring the applicator pads 21, 22 into intimate forceful contact with the sidewalls S of the now rotating tire T. The pressure regulator 423 controls the pressure exerted against the sidewalls S of the tire T to assure that the paint is uniformly applied thereto without skipping or excessive application. It has been assumed, of course, that the porous pads 333 (FIGS. 13 and 14 are saturated with the tire paint which is controlled by depressing a normally spring-biased open palm actuated valve 453 which directs pressurized air from the line 352 over a line 454, the valve 453 and a tire paint line 455 to pressurize and direct tire paint to and through the manifolds 339 and the tubes 341 thereof (FIG. 3) onto the top of the porous pads 333 which is absorbed thereby and, of course, subsequently applied to the sidewalls S of the tire T. The palm actuated valve 453 need but be depressed or closed when tire paint is to be added to the pads 333, and this is not necessarily done during the painting of each tire since the pads can accumulate and retain sufficient tire paint for painting more than a single tire.

During the painting of the sidewalls S, another normally closed spring-biased open palm actuated valve 463 on the console 101 is closed to direct high pressure air from the line 352 through the valve 463 and pressurize paint in a line 464 to create a spray discharging from the nozzles 342 directed toward the tire crowns C. The nozzles 342 not only spray tire paint from associated nozzles (unnumbered) thereof, but the same nozzles 342 have separate orifices for directing air into the tire paint spray to create an atomized spray of air and tire paint. The air for atomizing the tire paint sprayed from the nozzles 342 is directed to air orifices (not shown) of the latter nozzles from the source of pressurized air 351 over a line 473 which includes a pressure regulator 474. A switching valve 475 is moved to the position shown in FIG. 15 upon the depression of a palm actuated valve 463 to direct pressurized air through a line 476 which exits the air orifices of the nozzles 342. When the palm actuated valve 463 is released, the switching valve 475 moves to its closed position cutting off air to the air orifices of the nozzles 342 and, of course, the same release of the valve 463 cuts off paint supply over the line 464 to the nozzles 342.

At the completion of the interior coating and sidewall painting of the tire T, the various handles 358, 365, 410, 421 and 401 of the respective switching valves, 357, 366, 411, 424 and 339 are manipulated to reverse the sequence just described relative to the fluid motors 51, 123, 190, 273, 274 and 300, respectively, to essentially spread the applicator pad carrying arms 23, 24 away from each other, retract the same to the right, as viewed in FIGS. 8 and 9, alter the position of the carriage 70 if desired, lift upwardly and retract the frame 40 to the solid outline position shown in FIG. 7, and if desired, lower the carriage 50 thereof. The latter cuts off the drive to the motor 100 as the limit switches 372, 373 open the respective valves 374, 375 thereof, and the tire T can now be removed from the machine 10.

Although a preferred embodiment of the invention has been specifically illustrated and described herein, it is to be understood that minor variations may be made in the apparatus and the method without departing from the spirit and scope of the invention as defined in the appended claims.

I claim:

1. Apparatus for painting the exterior sidewall surfaces of a tire comprising means for rotating a tire about its axis, a carriage, said carriage including first and second paint applicator carrying arms carrying respective first and second paint applicators for applying paint to exterior sidewall surfaces of a tire during the rotation thereof, said paint applicator carrying arms being disposed in generally parallel relationship to each other, first means mounting said paint applicator carrying arms upon said carriage for reciprocal sliding movement toward and away from each other in a first reciprocal movement direction, first means for selectively moving said paint applicator carrying arms toward and away from each other in said first direction thereby accommodating tires of different width between said paint applicators, second means mounting said paint applicator carrying arms upon said carriage for reciprocal sliding movement in a second reciprocal movement direction generally normal to said first direction and to said tire axis, second means for selectively reciprocally moving said paint applicator carrying arms toward and away from said tire axis in said second direction thereby accommodating tires of different diameters between said paint applicators, and third means for selectively reciprocally moving said carriage in a third reciprocal movement direction generally normal to said second direction thereby accommodating tires of different heights.

2. The painting apparatus as defined in claim 1 wherein at least one of said first, second and third moving means includes a fluid motor.

3. The painting apparatus as defined in claim 1 wherein at least one of said first, second and third moving means includes a piston and cylinder mechanism.

4. The painting apparatus as defined in claim 1 wherein at least one of said first, second and third moving means includes a pair of fluid motors.

5. The painting apparatus as defined in claim 1 wherein at least one of said first, second and third moving means includes a pair of piston and cylinder mechanisms.

6. The painting apparatus as defined in claim 1 wherein at least one of said first, second and third moving means includes a pair of fluid motors, and at least another of the remaining first, second and third moving means includes a fluid motor.

7. The painting apparatus as defined in claim 1 wherein at least one of said first, second and third moving means includes a pair of fluid motors, and the remaining of the first, second and third moving means each includes a fluid motor.

8. The painting apparatus as defined in claim 1 wherein at least one of said first, second and third moving means includes a pair of piston and cylinder mechanisms, and at least another of the remaining first, second and third moving means includes a piston and cylinder mechanism.

9. The painting apparatus as defined in claim 1 wherein at least one of said first, second and third moving means includes a pair of piston and cylinder mechanisms, and the remaining of the first, second and third moving means each includes a piston and cylinder mechanism.

10. The apparatus as defined in claim 1 wherein at least one of said first and second mounting means includes a sliding sleeve and rod connection.

11. The apparatus as defined in claim 1 wherein each of said first and second mounting means includes a sliding sleeve and rod connection.

12. The apparatus as defined in claim 1 wherein each of said first and second paint applicators includes a porous pad, and means for delivering tire paint to each of said porous pads.

13. The apparatus as defined in claim 1 including hood means for defining a paint application chamber within which said first and second paint applicators are located, and said hood means is carried by said second mounting means for movement therewith in said second reciprocal movement direction.

14. The apparatus as defined in claim 1 including means for applying a coating of material to an interior surface of a tire during the rotation thereof.

15. The apparatus as defined in claim 1 including means for applying a coating of material to an interior surface of a tire during the rotation thereof, a second carriage, fourth means for selectively reciprocally moving said second carriage in a fourth reciprocal movement direction generally parallel to said third direction, said coating applying means being carried by said second carriage thereby accommodating tires of different diameter relative to said coating applying means third means mounting said coating applying means upon said second carriage for reciprocal sliding movement in a fifth reciprocal movement direction generally normal to said fourth direction and parallel to the tire axis, and fifth means for selectively reciprocally moving said coating applying means in the fifth direction thereby accommodating tires of different widths relative to said coating applying means.

16. The apparatus as defined in claim 1 including means for applying a coating of material to an interior surface of a tire during the rotation thereof, a second carriage, fourth means for selectively reciprocally moving said second carriage in a fourth reciprocal movement direction generally parallel to said third direction, said coating applying means being carried by said second carriage thereby accommodating tires of different diameter relative to said coating applying means, third means mounting said coating applying means upon said second carriage for reciprocal sliding movement in a fifth reciprocal movement direction generally normal to said fourth direction and parallel to the tire axis, fifth means for selectively reciprocally moving said coating applying means in the fifth direction thereby accommodating tires of different widths relative to said coating applying means, and at least one of said fourth and fifth moving means includes a fluid motor.

17. The apparatus as defined in claim 1 including means for applying a coating of material to an interior surface of a tire during the rotation thereof, a second carriage, fourth means for selectively reciprocally moving said second carriage in a fourth reciprocal movement direction generally parallel to said third direction, said coating applying means being carried by said second carriage thereby accommodating tires of different diameter relative to said coating applying means, third means mounting said coating applying means upon said second carriage for reciprocal sliding movement in a fifth reciprocal movement direction generally normal to said fourth direction and parallel to the tire axis, fifth means for selectively reciprocally moving said coating applying means in the fifth direction thereby accommodating tires of different widths relative to said coating applying means, and both of said fourth and fifth moving means includes a fluid motor.

18. The apparatus as defined in claim 1 including means for applying a coating of material to an interior surface of a tire during the rotation thereof, a second carriage, fourth means for selectively reciprocally moving said second carriage in a fourth reciprocal movement direction generally parallel to said third direction, said coating applying means being carried by said second carriage thereby accommodating tires of different diameter relative to said coating applying means, third means mounting said coating applying means upon said second carriage for reciprocal sliding movement in a fifth reciprocal movement direction generally normal to said fourth direction and parallel to the tire axis, fifth means for selectively reciprocally moving said coating applying means in the fifth direction thereby accommodating tires of different widths relative to said coating applying means, and at least one of said fourth and fifth moving means includes a piston and cylinder mechanism.

19. The apparatus as defined in claim 1 including means for applying a coating of material to an interior surface of a tire during the rotation thereof, a second carriage, fourth means for selectively reciprocally moving said second carriage in a fourth reciprocal movement direction generally parallel to said third direction, said coating applying means being carried by said second carriage thereby accommodating tires of different diameter relative to said coating applying means, third means mounting said coating applying means upon said second carriage for reciprocal sliding movement in a fifth reciprocal movement direction generally normal to said fourth direction and parallel to the tire axis, fifth means for selectively reciprocally moving said coating applying means in the fifth direction thereby accommodating tires of different widths relative to said coating applying means, and both of said fourth and fifth moving means includes a piston and cylinder mechanism.

20. The apparatus as defined in claim 3 wherein at least one of said first and second mounting means includes a sliding sleeve and rod connection.

21. The apparatus as defined in claim 3 wherein each of said first and second mounting means includes a sliding sleeve and rod connection.

22. The apparatus as defined in claim 3 wherein each of said first and second paint applicators includes a porous pad, and means for delivering tire paint to each of said porous pads.

23. The apparatus as defined in claim 3 including hood means for defining a paint application chamber within which said first and second paint applicators are located, and said hood means is carried by said second mounting means for movement therewith in said second reciprocal movement direction.

24. The apparatus as defined in claim 3 including means for applying a coating of material to an interior surface of a tire during the rotation thereof, a second carriage, fourth means for selectively reciprocally moving said second carriage in a fourth reciprocal movement direction generally parallel to said third direction, said coating applying means being carried by said second carriage thereby accommodating tires of different diameter relative to said coating applying means, third means mounting said coating applying means upon said second carriage for reciprocal sliding movement in a fifth reciprocal movement direction generally normal to said fourth direction and parallel to the tire axis, and fifth means for selectively reciprocally moving said coating applying means in the fifth direction thereby accommodating tires of different widths relative to said coating applying means.

25. The apparatus as defined in claim 5 wherein at least one of said first and second mounting means includes a sliding sleeve and rod connection.

26. The apparatus as defined in claim 5 wherein each of said first and second mounting means includes a sliding sleeve and rod connection.

27. The apparatus as defined in claim 5 wherein each of said first and second paint applicators includes a porous pad, and means for delivering tire paint to each of said porous pads.

28. The apparatus as defined in claim 5 including hood means for defining a paint application chamber within which said first and second paint applicators are located, and said hood means is carried by said second mounting means for movement therewith in said second reciprocal movement direction.

29. The apparatus as defined in claim 5 including means for applying a coating of material to an interior surface of a tire during the rotation thereof, a second carriage, fourth means for selectively reciprocally moving said second carriage in a fourth reciprocal movement direction generally parallel to said third direction, said coating applying means being carried by said second carriage thereby accommodating tires of different diameter relative to said coating applying means, third means mounting said coating applying means upon said second carriage for reciprocal sliding movement in a fifth reciprocal movement direction generally normal to said fourth direction and parallel to the tire axis, and fifth means for selectively reciprocally moving said coating applying means in the fifth direction thereby accommodating tires of different widths relative to said coating applying means.

* * * * *